United States Patent [19]

van Hesden

[11] 4,115,285

[45] Sep. 19, 1978

[54] CUTTING OIL ADDITIVES

[75] Inventor: Jan Willem van Hesden, Baulkham Hills, Australia

[73] Assignee: Borg-Warner Corporation, Chicago, Ill.

[21] Appl. No.: 805,670

[22] Filed: Jun. 13, 1977

[51] Int. Cl.[2] ..... C10M 1/44; C10M 3/38; C10M 7/24; C05B 11/16

[52] U.S. Cl. ..... 252/32.5; 72/42

[58] Field of Search ..... 252/32.5; 72/42

[56] References Cited

U.S. PATENT DOCUMENTS

| | | | |
|---|---|---|---|
| 2,329,707 | 9/1943 | Farrington et al. | 252/32.5 |
| 3,494,949 | 2/1970 | Monroe et al. | 252/32.5 |
| 3,575,859 | 4/1971 | Monroe | 252/32.5 |
| 3,757,864 | 9/1973 | Crawford et al. | 137/13 |
| 3,933,658 | 1/1976 | Beiswanger et al. | 252/32.5 |
| 4,031,014 | 6/1977 | Griffin | 252/32.5 |

*Primary Examiner*—Irving Vaughn

*Attorney, Agent, or Firm*—Richard J. Schlott

[57] ABSTRACT

The addition of a partially neutralized aluminum acid alkylorthophosphate to hydrocarbon cutting oils improves machinability and extends tool life in metal-machining operations.

5 Claims, No Drawings

CUTTING OIL ADDITIVES

BACKGROUND OF THE INVENTION

This invention relates to an improved fluid composition for use in metal cutting operations. More particularly the invention relates to fluid compositions comprising a hydrocarbon and an aluminum acid alkylorthophosphate for use as cutting fluids in metal-machining operations. Still more particularly, the invention relates to a method for reducing wear of tools used in metal-machining operations comprising the including of an aluminum acid alkylorthophosphate as an additive for hydrocarbon cutting fluids.

Finished metal parts are usually machined to final size and shape from stock previously rough-formed by casting, forging, rolling, or extrusion. The machining is done with tools having sharp cutting edges made of materials harder than the metal to be cut. There are a variety of machining operations, such as turning, boring, facing, shaping and planning with single-point tools; milling flat or formed surfaces with multipoint milling cutters; originating holes with two-lipped drills; enlarging holes to size with reamers; broaching internal or external surfaces with multitooth broach cutters; and threading, sawing, and grinding, with appropriate tools.

Most metal-machining operations require the use of some type of cutting fluid. Machining of metals causes deformation, rubbing, and friction. The resulting temperature rise can warp the work and damage or excessively wear the tool. Also, the metal will tend to expand, causing inaccuracies in the work. Cutting fluids are used mainly for cooling, but they may serve other purposes. In certain instances the surface finish is improved by the use of a cutting fluid. Often the fluid also serves to lubricate the slides on the machine or to protect the machine from corrosion. In many operations the fluid washes away metal chips and particles that could clog or interfere with the tool and the machine.

Cutting fluids commonly applied to the work and tool to assist in cutting operations include air, used as suction or blast, water containing an alkali; an emulsion of soluble oil and water, straight mineral oils or mixtures of mineral oils with fatty oils, and straight oils or mixed oils that have been sulfurized, chlorinated or both. The sulfurized oils are used for low cutting speeds on operations such as threading, gear cutting, reaming, and broaching primarily to provide good surface finish and high dimensional accuracy. The use of oils increases cutting speeds by 8 to 15%.

SUMMARY OF THE INVENTION

Liquid compositions comprising hydrocarbon and an aluminum acid alkylorthophosphate are useful as cutting fluids in machining operations. The addition of minor amounts of aluminum acid alkylorthophosphates to hydrocarbon cutting fluids greatly decreases tool wear and consequently improves tool life. The instant invention is thus a cutting fluid composition comprising a hydrocarbon and a minor amount of an aluminum acid alkylorthophosphate, and a method for reducing wear of tools used in metal cutting operations.

DETAILED DESCRIPTION OF THE INVENTION

The variety of hydrocarbon oils used as cutting fluids in metal working ranges from light, low viscosity mineral oils to higher viscosity, heavy hydrocarbon oils.

Selection of the cutting fluid to be employed for a particular operation will be based in part upon the machinability of the work piece and the particular machining operation to be used. Any of the hydrocarbon oils thus selected to be used as a cutting fluid will be improved in machinability by the addition of an aluminum acid alkylorthophosphate according to the process of this invention.

The aluminum acid alkylorthophosphates useful as additives for hydrocarbon cutting oils may be generally described as the products of partial neutralization of an alkyl orthophosphoric acid with a basic aluminum compound. Alkyl orthophosphoric acids are readily prepared by the reaction of phosphorus pentoxide with alcohols, according to the classical formula:

$$P_2O_5 + 3ROH\ ROPO(OH)_2 + (RO)_2POOH$$

Wherein R is a $C_1$–$C_{22}$ alkyl or alkenyl radical or a mixture thereof. The product mixture thus contains both mono and dialkyl acid phosphates, with three reactive acidic groups for every two atoms of phosphorus, which may also be represented by the formula $H_3$ [alkylorthophosphate]$_2$. The acidic mixture will thus require three equivalents of reactive base to completely neutralize the remaining acidity.

The aluminum acid alkylorthophosphates are prepared by reacting less than a stoichiometeric quantity of a basic aluminum compound such as hydrated alumina or aluminum isopropoxide with the alkyl orthophosphoric acid. The amount of basic aluminum compound may be varied between 20 and 70% of the stoichiometric amount, i.e., the amount required to fully neutralize the acidity of the alkyl orthophosphoric acid.

The preparation of full aluminum salts of alkyl orthophosphoric acids is described in U.S. Pat. No. 2,329,707. Compositions containing a nearly or completely stoichiometric quantity of aluminum are hard, waxy materials which dissolve or disperse in hydrocarbon oils only with great difficulty, normally requiring extended stirring and heating cycles. The aluminum acid alkylorthophosphates of the instant invention are readily dissolved or dispersed in hydrocarbon oils without thickening or imparting significant changes in viscosity.

The amount of aluminum acid alkylorthophosphate employed to impart improved machinability to hydrocarbon oils may be varied according to the characteristics of the cutting operation, however in general only a minor amount will suffice for most applications, with from 0.1 to 3 wt% of the additive based on final composition being adequate for most cutting and machining operations.

The cutting oil composition may further comprise a variety of additives commonly employed in cutting oil compositions, including sulfated fats, chlorinated waxes, corrosion inhibitors, viscosity improvers and the like. Further, where the use of an acidic composition may be detrimental to the work piece or the machinery, the composition may be adjusted by addition thereto of a basic compound such as for example an alkali, an amine or the like.

The practice of the invention is further illustrated by means of the following examples which are not to be construed as limiting the scope of the invention.

EXAMPLE 1

An aluminum acid alkyl orthophosphate was prepared in the following manner: 112 g. of $P_2O_5$ were mixed with 74.7 g. of butyl alcohol and 384.2 g. (1.7 m.) of a commercial mixture of $C_{12}$–$C_{22}$ n-alkanols. The reaction mixture was heated to a gentle reflux and stirred until all the $P_2O_5$ had reacted.

The resulting mixture of alkyl orthophosphoric acids was then reacted with 26.5g. (42% of stoichiometry) of hydrated alumina by mixing the components and heating the mixture at 110° C. for about an hour. The resulting aluminum acid alkyl orthophosphate was a viscous oil.

EXAMPLE 2

A cutting oil base was prepared by mixing 10 gal. of a commerical naphthenic process oil having a viscosity of 67 centistokes at 100° F with 5 gal. of a second commercial naphthenic process oil having a viscosity of 23.4 centistokes at 100° F.

To 18 liters of the base oil were then added with stirring 65.35 g (0.4 wt%) of the aluminum acid alkylorthophosphate prepared in Example 1. The final composition was clear and showed no visible thickening.

EXAMPLE 3

An 18 liter batch of base oil containing 65.35g (0.4 wt%) of the aluminum acid alkylorthophosphate of Example 1 was prepared as in Example 2. The acidity was neutralized by stirring into the batch 16 ml. of 15 wt% aqueous sodium hydroxide. The final composition was clear and showed only a slight increase in viscosity, from 100 cps to 132 cps, measured with a Brookfield viscometer using a #3 spindle at 50 rpm.

EXAMPLE 4

An 18 liter batch of base oil containing 65.35g (0.4 wt%) of aluminum acid alkylorthophosphate was prepared as in Example 2. The batch was then made alkaline by stirring in 34 ml of 15 wt% aqueous sodium hydroxide. There was no visible thickening, and the viscosity was 95 cps, measured as before.

The cutting oils prepared in Examples 2–4 were evaluated in a comparison test by milling cold-finished 1018 steel bar stock, using a 14 tooth cutter at 160 rpm, fed 0.100 inch deep at 2 inches/min, for a total of 600 lineal inches per test. The wear for each of the 14 teeth was then measured by inspection at 100x magnification and averaged. The wear data are presented in tabular form, Table I.

Table I

| Example No. | Oil[1] | Comparative Wear Data — wear at: Top | Corner | Front | Combined |
|---|---|---|---|---|---|
| 5 | control | 56 | 157 | 128 | 113 |
| 6 | Ex. 2 | 34 | 46 | 106 | 62 |
| 7 | Ex. 3 | 43 | 75 | 111 | 80 |
| 8 | Ex. 4 | 42 | 65 | 104 | 70 |

Notes: [1]Control = base oil prepared as in Example 2, without additive.

It will be apparent from these data that 0.4 wt% of aluminum acid alkylorthophosphate in a base cutting oil (Example 6) markedly decreases tool wear in three key areas, as compared with uncompounded base cutting oil (Example 5). Neutralizing the acidity as in Example 7 or making the composition distinctly alkaline as in Example 8 does not destroy the wear reducing effect of the additive, even though wear is slightly increased over the acidic composition of Example 2.

EXAMPLE 9

To 18 liters of commercial cutting oil containing 18 vol.% sulfurized sperm oil were added with stirring 65.35g (0.4 wt%) of aluminum acid alkylorthophosphate. Evaluation of this cutting oil was then carried out as before, but employing a more severe sequence of 600 lineal inches of cut at 200 rpm, 2.5 inches/min, followed by 300 lineal inches of cut at 250 rpm, 2.5 inches/min. The cutting oil with aluminum acid alkylorthophosphate had an average tool wear rating of 59, while the control oil without additive gave a tool wear rating of 73.

In a separate test series using the compounded oil of Example 9 and a milling schedule of 600 lineal inches of cut at 200 rpm, 2 inches/min., the average tool wear rating for three runs was 32, 37 and 38. The control oil without additive gave an average tool wear rating of 99.

EXAMPLE 10

To 18 liters of commercial cutting oil containing 18 vol.% sulfurized sperm oil were added 270g (1.5 wt%) of the aluminum acid alkylorthophosphate of Example 1. The mixture was stirred, and the acidity was then neutralized by adding 760 drops of 30 wt% aqueous sodium hydroxide. No increase in viscosity or thickening was apparent.

The cutting oil mixture was diluted with additional cutting oil to a total volume of 35 imperial gallons and placed in the sump of a Ch rchill gear hobbing machine. The final phosphate additive concentration amounted to 0.16 wt%. Cluster gears for manual transmissions were then hobbed using a tool (hobber) speed of 310 rpm. Tool life, measured as average number of cluster gears cut per 0.001 inch of tool wear, was increased from an eleven day average of 5.3 parts using cutting oil without the aluminum acid alkylorthophosphate to 8.0 for an eleven day average using the cutting oil of Example 10 containing 0.16 wt% aluminum acid alkylorthophosphate.

It will thus be apparent from these test data that minor amounts of aluminum acid alkylorthophosphates are effective in decreasing tool wear and extending tool life when included in hydrocarbon cutting oils.

The invention is thus an improved cutting oil composition for use in metal-machining operations comprising a hydrocarbon oil and a minor amount of an aluminum acid alkylorthophosphate, and a method for reducing tool wear in metal-machining operations.

I claim:

1. A fluid composition adapted for use as a cutting oil comprising a hydrocarbon oil and from about 0.1 to about 3 wt.% of a partially neutralized aluminum acid alkylorthophosphate.

2. The composition of claim 1 wherein the aluminum acid alkylorthophosphate is the product of the reaction of an alkyl orthophosphoric acid with from about 20 to about 70% of the stoichiometric amount of a basic aluminum compound, said alkyl orthophosphoric acid being the product of the reaction of $P_2O_5$ with an alcohol selected from the group consisting of $C_1$–$C_{22}$ alkanols, $C_2$–$C_{22}$ alkenols and mixtures thereof.

3. In metal-machining operations, a method for decreasing tool wear consisting of employing a cutting oil composition comprising a hydrocarbon oil and a partially neutralized effective amount of an aluminum acid alkylorthophosphate.

4. The method of claim 3 wherein the aluminum acid alkylorthophosphate is the product of the reaction of an alkyl orthophosphoric acid with from about 20 to about 70% of the stoichiometric amount of a basic aluminum compound, said alkyl orthophosphoric acid being the product of the reaction of $P_2O_5$ with an alcohol selected from the group consisting of $C_1$–$C_{22}$ alkanols, $C_2$–$C_{22}$ alkenols and mixtures thereof.

5. The method of claim 3 wherein said aluminum acid alkylorthophosphate is present in from about 0.1 to about 3 wt% based on total composition.

* * * * *